US006063212A

United States Patent [19]

Cabral

[11] Patent Number: 6,063,212

[45] Date of Patent: May 16, 2000

[54] HEAT TREATED, SPRAY FORMED SUPERALLOY ARTICLES AND METHOD OF MAKING THE SAME

[75] Inventor: Antonio C. Cabral, Coventry, Conn.

[73] Assignee: United Technologies Corporation, Hartford, Conn.

[21] Appl. No.: 09/076,767

[22] Filed: May 12, 1998

[51] Int. Cl.[7] ..... C22C 19/03; C22C 19/05; C22C 1/10

[52] U.S. Cl. ..... 148/428; 148/410; 148/555; 148/675; 75/245; 427/456

[58] Field of Search ..... 148/428, 410, 148/556, 555, 675; 75/245, 338; 427/456

[56] References Cited

U.S. PATENT DOCUMENTS

| | | | |
|---|---|---|---|
| 3,670,400 | 6/1972 | Singer | 29/527.5 |
| 3,970,249 | 7/1976 | Singer | 239/102 |
| 4,064,295 | 12/1977 | Singer | 427/424 |
| 4,224,356 | 9/1980 | Singer | 427/34 |
| 4,420,441 | 12/1983 | Singer | 264/7 |
| 4,515,864 | 5/1985 | Singer | 428/546 |
| 4,579,168 | 4/1986 | Singer | 164/480 |
| 4,830,084 | 5/1989 | Singer | 164/46 |
| 4,983,427 | 1/1991 | Sansome et al. | 427/347 |
| 5,106,266 | 4/1992 | Borns et al. | 416/241 R |
| 5,173,339 | 12/1992 | Singer | 427/289 |
| 5,245,153 | 9/1993 | Singer et al. | 219/76.15 |
| 5,337,631 | 8/1994 | Singer et al. | 76/107.1 |
| 5,476,222 | 12/1995 | Singer et al. | 239/99 |
| 5,516,586 | 5/1996 | Singer et al. | 428/433 |
| 5,584,948 | 12/1996 | Huron | 148/556 |

FOREIGN PATENT DOCUMENTS

| | | | |
|---|---|---|---|
| 0 848 078 A1 | 6/1998 | European Pat. Off. | C23C 4/12 |
| 2 085 778 | 5/1982 | United Kingdom | B22D 25/00 |

OTHER PUBLICATIONS

"Spray Forming Could Cut Engine Component Cost", by Michael O. Lavitt, Reprinted from Aviation Week & Space Technology, Mar. 17, 1997, Copyright by The McGraw–Hill Companies, Inc.

Society of Automotive Engineers, Inc., Aerospace Material Specification, AMS 5663H "Nickel Alloy, Corrosion and Heat Resistant, Bars, Forgings, And Rings" Issued Sep., 1965, Revised Jan., 1996.

"Manufacturing With the Spraycast Process", by Dr. Neil Paton, Kim Bowen, Dr. Thomas Tom and Tony Cabral, Foundry Management & Technology, Oct. 1997, Copyright©1997 Penton Publishing, Inc., Cleveland, Ohio 44114.

Fiedler, H.C., Sawyer, T.F., Kopp, R.W.and Leatham, A.G., Journal of Metals, vol. 39, No. 8, Aug. 1, 1987, *The Spray Forming of Superalloys*, pp. 28–33.

Benz, M.G., Sawyer, T.F., Carter, W.T., Zabala, R.J., and Dupree, P.L., Powder Metallurgy, vol. 37, No. 3, Jan. 1, 1994, *Nitrogren in spray formed superalloys*, pp. 213–218.

Butzer, Greg and Bowen, Kim, Advanced Materials and Processes, vol. 153, No. 3, Mar. 1, 1998, Spray *Forming Aerospace Alloys*, pp. 21–23.

*Primary Examiner*—Deborah Yee
*Attorney, Agent, or Firm*—F. Tyler Morrison, III

[57] ABSTRACT

Heat treated, spray formed articles are disclosed which exhibit crack growth rates and resistance to stress rupture comparable to corresponding, forged articles. The articles are first formed by depositing molten metal droplets, e.g., of IN 718, on a substrate to form a rough article. The articles are HIP'ed and then processed by heat treating, which includes solution, stabilization and precipitation heat treatments. The resultant articles have fine average grain sizes compared to forged and conventionally heat treated material, as well as yield and tensile strengths comparable to forged material. Importantly, the articles also exhibit low crack growth rates and stress rupture resistance, e.g., comparable to forged material, and have an isotropic microstructure. The articles can be used in place of forged articles.

22 Claims, 4 Drawing Sheets

100X

Spray Formed + Solution Heat Treated Inconel 718 Microstructure

100X

Spray Formed + Stabilization Heat Treated Inconel 718 Microstructure

100X

Typical Forged Inconel 718 (AMS 5663) Microstructure

HEAT TREATED, SPRAY FORMED SUPERALLOY ARTICLES AND METHOD OF MAKING THE SAME

BACKGROUND OF THE INVENTION

The present invention relates generally to spray formed components, and more particularly to spray formed components having properties comparable to those of corresponding forged components.

Forging has long been used to produce components for demanding applications, e.g., for components which require a combination of high strength and other desired properties such as low crack growth rates and high stress rupture resistance. In the aerospace industry, forging is used to produce parts having complex shapes such as blades and vanes, and annular-shaped components such as engine cases, flanges and seals, each of which typically requires a combination of high strength, low crack growth rates and high stress rupture resistance.

With particular reference to forging annular-shaped components, a billet of material is obtained having a composition corresponding to the desired composition of the finished component. The billet is typically prepared from ingots of the material. The billet is first pierced, and is then thermomechanically processed, such as by ring-rolling one or more times to transform the billet material into the general component shape. The component may also be heat treated to obtain desired properties, e.g., a particular level of fatigue crack growth resistance, and then finished, e.g., polished or machined to provide the component with the precise dimensions or features.

The production of components by forging is an expensive, time consuming process, and thus is typically warranted only for components that require a particularly high level of various properties, e.g., high strength with low crack growth rates and high stress rupture resistance. With respect to obtaining the billets for forging, certain materials require lead times measured in months. During component fabrication, much of the original billet material is removed and does not form part of the finished component, e.g., it is waste. The complexity of the shape of the component produced merely adds to the effort and expense required to fabricate the component. In addition, finished components may still require extensive machining or other finishing. Moreover, in order to operate gas turbine engines at higher temperatures to increase efficiency or power or both, components fabricated from increasingly more advanced alloys are required. Many of these more advanced alloys are increasingly difficult or impossible to forge, which adds further to the cost of the components or renders the components so expensive that it is not economically feasible to exploit certain advances in engine technology, or to utilize particular alloys for some components.

Spray forming has not previously been used to produce components directly from bulk material, e.g., material in ingot form, which exhibit not only high strength, but also low crack growth rates and high stress rupture resistance. In the case of IN 718, discussed further below including reference to FIG. 5, low crack growth rates and high stress rupture resistance corresponds to meeting the requirements set forth in Aerospace Material Specification AMS 5663 (Rev. H, publ. January 1996), published by SAE Int'l of Warrendale, Pa., and is incorporated by reference herein. It is this combination which is produced in accordance with the present invention. A typical spray forming apparatus is illustrated in FIG. 1. Metal is provided in ingot form and melted in a crucible 12, preferably in a vacuum melt chamber 14 at low pressure and/or in a non-reactive environment. The molten metal 16 is transferred to a tundish 18, and then passes through an atomizer 20, which utilizes an inert carrier gas such as argon to entrain atomized metal droplets. The atomized material 22 impinges upon and is deposited onto a cooled mandrel or substrate 24 that is located in a spray chamber 26. In order to form an annular component, the mandrel is cylindrical and may be rotated, and the stream of atomized metal and the mandrel may be scanned relative to one another. The metal impinges upon the substrate and previously deposited metal, and solidifies rapidly. Layers of the solidified metal then build upon one another to form the desired article. See, e.g., U.S. Pat. No. 4,830,084. The article may then be further treated, e.g., by hot isostatic pressing (HIP'ing) and/or thermomechanically processing such as by ring rolling to densify and strengthen the material. Superalloys have been melted and spray formed in this manner to form parts, although such parts as formed lack properties such as high strength. Low crack growth rates or stress rupture resistance and thus cannot be employed as formed in demanding applications such as gas turbine engines or other high temperature and pressure environments.

One material which has been widely employed in producing forged parts for use in demanding applications is Inconel 718 ("IN 718"), which has a nominal composition of about 19 w/o Cr, 3.1 w/o Mo, 5.3 w/o Cb+Ta, 0.9 w/0 Ti, 0.6 w/o Al, 19 w/o Fe, balance essentially nickel and nominal amounts (in weight percentage) of other elements. As noted above, exemplary parts include gas turbine engine cases, flanges and seals, as well as blades and vanes. Once formed, these parts typically must still be machined and heat treated to obtain desired properties. AMS 5663 is a conventional heat treatment for parts forged from IN 718 and is incorporated by reference herein.

Under AMS 5663, a forged component is heat treated in two steps. The first step includes a solution heat treatment at a temperature of between 1725–1850° F., for a time that is proportional to the cross sectional thickness of the component, and then cooling at a rate equivalent to air cooling or faster. The second step includes a precipitation heat treatment at a temperature of between 1325–1400° F. for about eight (8) hours, followed by cooling at a rate of about 100° F. per hour to a temperature of about 1150–1200° F. and held at that temperature for about eight (8) hours, and then air cooled. The precipitation heat treatment may be altered by furnace cooling the part from 1325–1400° F. to 1150–1200° F. at any rate so long as the overall precipitation heat treatment time is about eighteen (18) hours. The resulting parts have yield strengths of at least about 150 ksi at room temperature and at least about 125 ksi at 1200° F., and exhibit relatively low notch sensitivity and high stress rupture resistance. Accordingly, parts produced by forging IN 718 and heat treated in accordance with AMS 5663 are suitable for use as gas turbine engine cases, flanges or seals, blades and vanes, as well as other demanding applications. However, forged components also often exhibit significant levels of coarse carbides and other inclusions, the levels of which vary significantly from component to component. Forged components tend to be difficult to machine and inspect. Moreover, precise reproducibility is also a concern—forging does not always result in components having dimensions that are identical from part to part. After inspection, many parts must still be re-worked. As a general rule, it is believed that forged parts must be scrapped or re-worked about 20% of the time.

In an effort to produce components more repeatably and at less expense, parts have been spray formed using IN 718. As spray formed and HIP'd, these parts do have significant strength, but exhibit high crack growth rates and inferior stress rupture resistance, and it has been believed that such parts need to be thermomechanically processed, e.g., forged or ring-rolled, to obtain these properties. The expense of such an added step has not been attractive.

As noted above, a standard, conventional heat treatment for components forged from IN 718 is set out in AMS 5663. However, we have determined that parts sprayformed from IN 718, and then HIP'ed and heat treated in accordance with AMS 5663 or other conventional heat treatments exhibit yield and tensile strengths similar to forged, but exhibit such inferior crack growth rates and stress rupture resistance that the components cannot be used in demanding applications when these considerations must be addressed.

It is a general object of the present invention to provide spray formed articles having properties comparable to properties of corresponding forged articles.

It is more specific object of the present invention to provide spray formed articles having a balance of strength, crack growth rates and stress rupture resistance comparable to corresponding forged articles.

It is another object of the present invention to provide a heat treatment for spray formed articles, whereby crack growth rates of the articles are low and stress rupture resistance of the articles are high.

It is yet another object of the present invention to provide a heat treatment to enable spray forming of materials which are not amenable to fabrication by conventional forging techniques.

It is still another object of the present invention to provide such a heat treatment to provide articles composed of spray formed IN 718 with properties comparable to those of corresponding articles forged from IN 718.

SUMMARY OF THE INVENTION

The present invention incorporates a spray formed article that is processed to provide high strength, and resistance to stress rupture and crack growth.

According to one aspect of the invention, a metal article is disclosed which is composed of a nickel-base superalloy formed by metal droplets built up on one another, for example by sprayforming. The article is then heat treated to provide the article with crack growth rates and stress rupture resistance comparable to the values for forged components heat treated in accordance with AMS 5663. The article is also characterized by material having an isotropic microstructure.

According to another aspect of the invention, a method is disclosed for generating a spray formed article composed of nickel-base superalloy that has enhanced stress rupture and crack growth resistance characteristics. The method comprises the steps of: spray forming an article, the article as formed characterized by a porosity of up to about 3 percent by volume; and heat treating the article sufficiently to reduce porosity and provide an article having crack growth rates and stress rupture resistance comparable to the values for forged components heat treated in accordance with AMS 5663.

DETAILED DESCRIPTION OF THE PREFERRED EMBODIMENT

Figure 1:
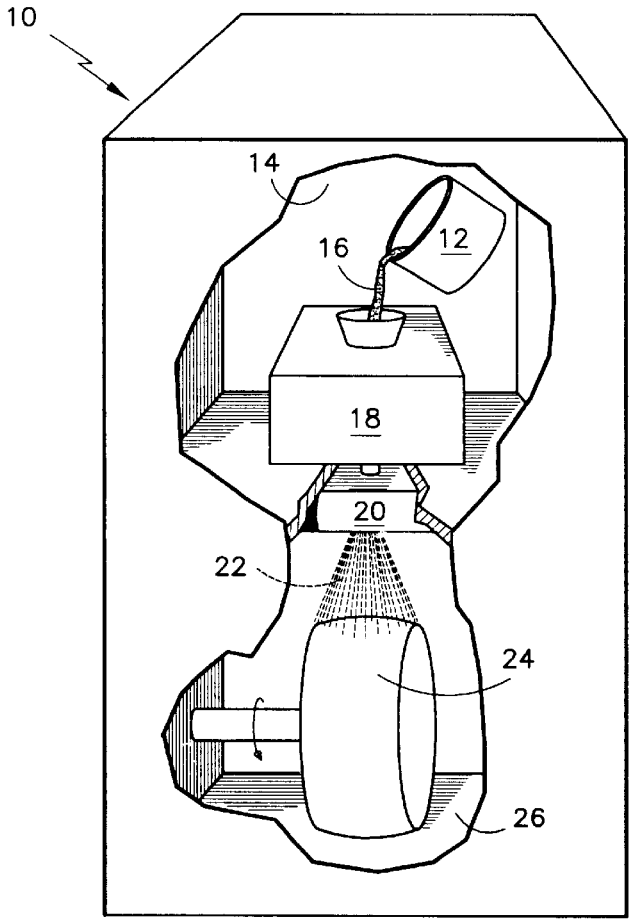
FIG. 1 is a schematic view, partially broken away, illustrating an apparatus for spray forming an article.

Returning to FIG. 1, an article to be heated treated in accordance with the present invention is first spray formed, in a manner known in the art. See, e.g., U.S. Pat. No. 4,515,864 to Singer entitled "Solid Metal Articles From Built Up Splat Particles", and U.S. Pat. No. 3,900,921 to Brooks entitled "Method and Apparatus for Making Shaped Metal Articles From Sprayed Metal or Metal Alloy", both of which are incorporated by reference herein. With respect to the preferred material for which the present invention is employed, the material is Inconel 718 (IN 718), which preferably has a composition in weight percent, of about 0.02–0.04 C, up to about 0.35 Mn, up to about 0.15 Si, 17–21 Cr, up to about 1 Co, 2.8–3.3 Mo+W+Re, 5.15–5.5 Cb+Ta, 0.75–1.15 Ti+V+Hf; 0.4–0.7 Al, up to about 19 Fe, balance essentially Ni and other elements (also by weight percent) such as up to about 0.01 S, up to about 0.015 P, 0.002–0.006 B, up to about 0.10 Cu, up to about 0.0030 Mg, up to about 0.0005 Pb, up to about 0.00003 Bi, up to about 0.0003 Se, up to about 0.0005 Ag, and also up to about 0.01 O, up to about 0.01 N. The articles are spray formed, and then HIP'ed and heat treated in accordance with the present invention, as described further below. Resulting articles are comparable to forgings, with respect to yield and tensile strengths at room temperature and elevated temperatures (e.g., around 1200° F.), and also low crack growth rates and high stress rupture resistance—all at significantly less expense, waste, effort and substantially reduced lead times compared to forging.

As discussed above, metal to be used in spray forming is provided, e.g., in ingot form, by melting an elemental mix, by re-melting scrap material or by other manner. The material is melted in a crucible 12, which preferably is positioned in a vacuum melt chamber 14 maintained at low pressure and/or in a non-reactive environment. The molten metal 16 is transferred to a tundish 18, and then passes through an atomizer 20, which utilizes an inert carrier gas such as argon to entrain the atomized metal. The atomized material 22 is directed towards a cooled mandrel or substrate 24 located in a spray chamber 26, which is preferably maintained at low pressure and/or in a non-reactive environment. In order to form an annular component, the mandrel is cylindrical and may be rotated, and the stream of atomized metal and the mandrel may be scanned relative to one another The metal impinges upon the substrate first and then upon previously deposited metal, and solidifies rapidly, thus providing a finer grain size than forgings. Layers of the solidified metal build up to form the desired article. While an article fabricated from IN 718 is described, those skilled in the art will recognize that articles made from other materials may also be sprayformed and thermomechanically processed such as by HIP'ing, and then heat treated in accordance with the present invention. It is believed that the present invention may be applied to alloys which utilize an acicular or needle phase to control grain size and impart grain boundary strength, including but not limited to IN 910 and IN 939. In addition, those skilled in the art will also recognize that there are other methods of depositing molten or semi-molten droplets of material on a substrate with equal effect, such as plasma spraying in a low pressure or vacuum environment which could be employed to form the article.

While the particular spray forming parameters are not believed to be critical to the present invention, we prefer that the droplets are smaller rather than larger, and more preferably on the order of about 10–10,000 microns in diameter. We also prefer that the droplets be applied at a temperature that is lower rather than higher. The droplets preferably should be no hotter than necessary to remain in a semi-molten state until impingement upon the substrate and previously deposited material, but hot enough so as not to substantially solidify prior to impingement. The velocity of the droplets must be fast enough to deliver the droplets in a molten state but slow enough so that the droplets are able to adhere to the substrate and previously deposited droplets. The distance between the spray nozzle and the substrate may also be adjusted, as may the rate at which the material is deposited.

Figure 2:
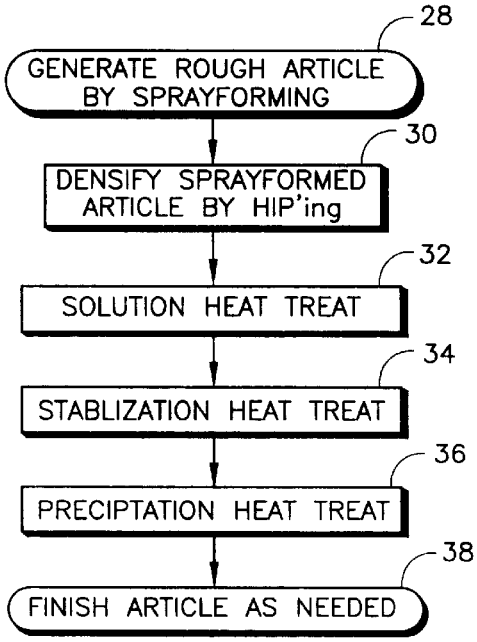
FIG. 2 is a flow diagram for heat treating articles in accordance with the present invention.

Spray formed articles, as formed, are characterized by the presence of porosity, typically about 1–3 percent by volume (v/o). In contrast, forged articles exhibit no porosity. Porosity tends to reduce the strength of an article. The spray-formed articles are treated to densify the material. With reference to FIG. 2, the articles which have been rough formed by spray forming are preferably first densified by HIP'ing. While the particular HIP'ing parameters vary depending upon to the material being HIP'ed and the degree to which porosity is to be reduced, for spray formed IN 718 the part is preferably HIP'ed at between about 1,800–2,000° F. and 15,000–25,000 psi for about four hours, more preferably in an inert atmosphere such as argon. The pressure and temperature are monitored, e.g., at least once every five minutes, to ensure consistent HIP'ing. While FIG. 2 illustrates any machining as occurring after the heat treatment, the articles may be machined to final dimensions at any time after HIP'ing.

The articles as spray formed exhibit stress rupture resistance and crack growth rates which are significantly inferior to corresponding forged articles. Heat treating these articles using industry standards for forged articles, such as AMS 5663 for IN 718, does not restore these properties to forged levels. HIP'ing the articles does not significantly improve those properties. Accordingly, the articles as spray formed and HIP'd only cannot be used in demanding applications such as gas turbine engines.

In accordance with the present invention, the spray formed and HIP'd articles are heat treated in order to provide a balance of strength, low crack growth rates and high stress rupture resistance, and thereby render articles suitable for use in demanding applications. As discussed further below, the preferred heat treatment includes a solution heat treatment 32, a stabilization heat treatment 34 and a precipitation heat treatment 36. The specific temperatures, times and cooling rates described below will vary according to the particular material being processed. The preferred heat treatment provides a spray formed article having a microstructure similar to that of conventionally forged material. Compare the microstructure of FIGS. 3*a* and 3*b* to FIG. 4. The articles are also finished 38 (FIG. 2) as needed, e.g., machined. The finishing may be performed at any time after HIP'ing.

Figure 3A:
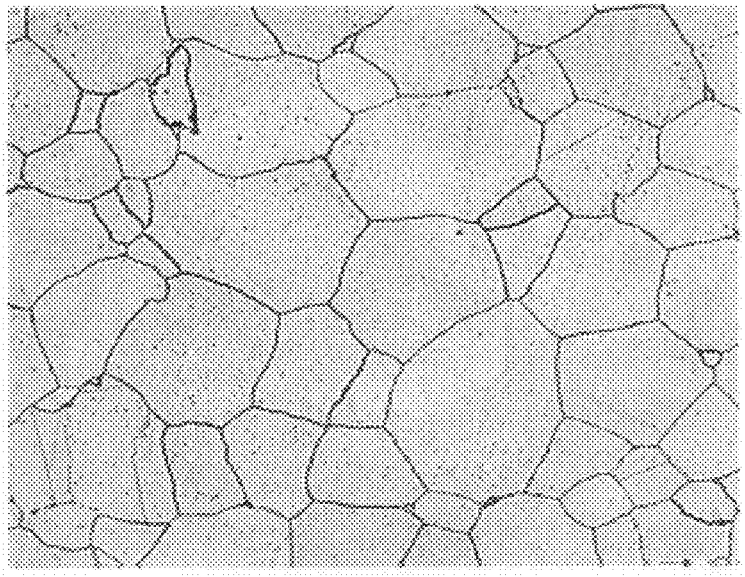
FIGS. 3*a* and 3*b* are photomicrographs of a spray formed article heat treated in accordance with the present invention.

The solution heat treatment 32 comprises the first portion of the heat treatment, and will vary depending upon the particular material being treated. For IN 718, the part is heated to a solution heat treatment temperature preferably between about 1800–1900° F., and preferably at about 1850° F. for about 1 hour, and cooled at a rate equivalent to air cooling or faster. The solution heat treatment temperature is selected to be lower than the temperature at which the grain size of the material would grow significantly, as larger grain sizes do not provide the desired properties. We have found that material such as IN 718, as spray formed, is less susceptible to grain growth at elevated temperatures than corresponding forged material, and accordingly the solution heat treatment may be performed at higher temperatures than a corresponding solution heat treatment provided in AMS 5663 for forged articles. FIG. 3*a* is a photomicrograph illustrating the microstructure of an article after the solution heat treatment of the present invention.

Figure 3B:
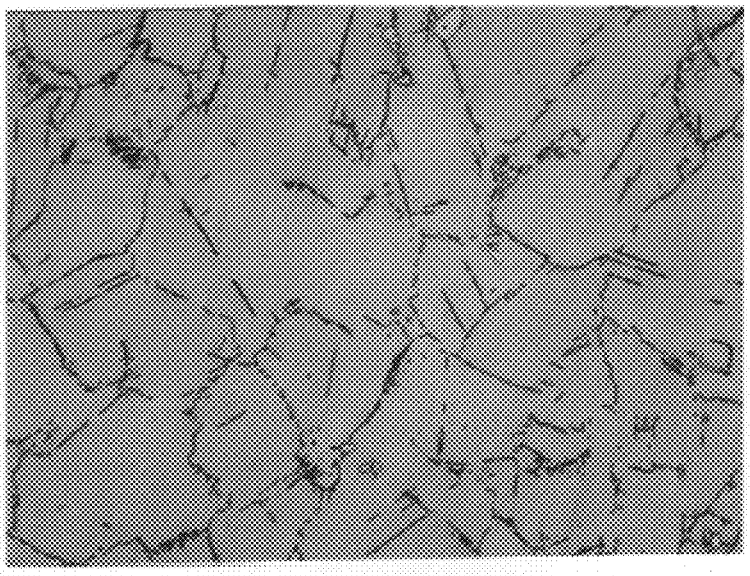
Figure 4:
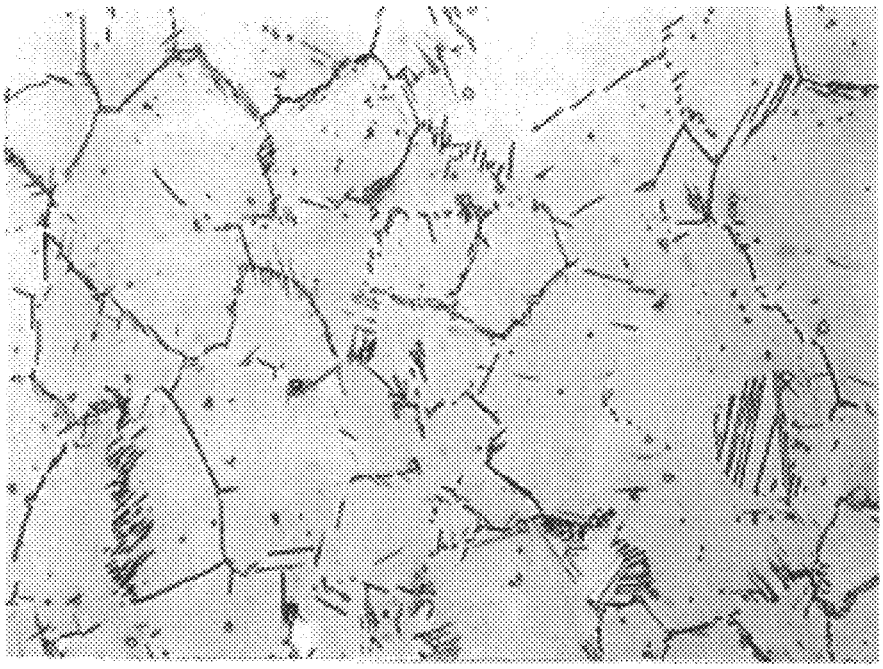
FIG. 4 is a photomicrograph of microstructure showing forged IN 718 after a conventional heat treatment.

After the solution heat treatment and cooling, the part is subjected to a stabilization heat treatment 34, the specifics of which will vary depending upon the particular material being treated. For articles fabricated from IN 718, the article is heated to a temperature of between about 1625–1700° F., and held at the stabilization heat treatment temperature for about four hours, and cooled at a rate equivalent to air cooling or faster. FIG. 3*b* is a photomicrograph illustrating the microstructure after the stabilization heat treatment of the present invention.

After the stabilization heat treatment and cooling, the part is subjected to a precipitation heat treatment 36, which will vary depending upon the particular material being treated. For IN 718, the part is heated to a temperature of between 1325–1400° F. for about eight hours, followed by cooling at a rate of about 100° F. per hour to a temperature of about 1150–1200° F. and held at that temperature for about eight hours, and then air cooled. The precipitation heat treatment may be altered by furnace cooling the part from 1325–1400° F. to 1150–1200° F. at any rate so long as the overall precipitation heat treatment time is about eighteen hours. The microstructure after the precipitation heat treatment of the present invention is visually similar to the microstructure illustrated in FIG. 3*b*.

As noted above, the illustrated application of the present invention enables the production of spray formed articles that have not only good strength, but also have other properties that are comparable to or better than forged components, e.g., low crack growth rates and high stress rupture resistance. Samples of the spray formed IN 718 heat treated in accordance with the present invention were tested to determine yield and ultimate tensile strengths, as well as ductility. With respect to tensile properties, samples were tested both at room temperature (68° F.) and elevated temperatures, e.g., 1200° F. held for a period of time prior to testing. The samples were subjected to strain rate of between 0.03–0.07 in./in./minute through the yield strength (about 147 ksi at room temperature and 122 ksi at 1200 F), and then the rate was increased to produce failure in about one minute later. The following properties were obtained:

| Property | Room Temp. | 1200° F. +/− 10 |
|---|---|---|
| Tensile Strength, min. | 183 ksi | 150 ksi |
| Yield Strength, 0.2% offset, min. | 147 ksi | 122 ksi |
| Elongation in 4D, min. | 12% | 12% |
| Reduction in area, min. | 15% | 20% |

The minimum values for these properties may be higher or lower, depending upon the particular application of the part.

The above values correspond, for example, to the above mentioned parts such as gas turbine engine cases, flanges and seals. The above properties are designed for specific parts such as engine cases and rings.

The above noted properties are comparable to those for forged IN 718, heat treated in accordance with AMS 5663, which calls for the following properties:

| Property | Room Temp. | 1200° F. +/− 10 |
|---|---|---|
| Tensile Strength, min. | 180 ksi | 140 ksi |
| Yield Strength, 0.2% offset, min | 150 ksi | 125 ksi |
| Elongation in 4D, min. | 10% | 10% |
| Reduction in area, min. | 12% | 12% |

As noted in AMS 5663, the properties for forged material differ depending upon whether the samples are tested longitudinally or transversely, e.g., the properties are not isotropic and the lower values are produced during transverse testing.

In addition, standard combination smooth and notched stress rupture test specimens (comprising material produced in accordance with the present invention), e.g., conforming to ASTM E292, were tested. The specimens were maintained at 1200° F. and loaded continuously, after generating an initial axial stress of between about 105–110 ksi. The specimens ruptured after at least 23 hours. The above values for IN 718 processed in accordance with the present invention are comparable to forged IN 718 heat treated in accordance with AMS 5663.

Figure 5:
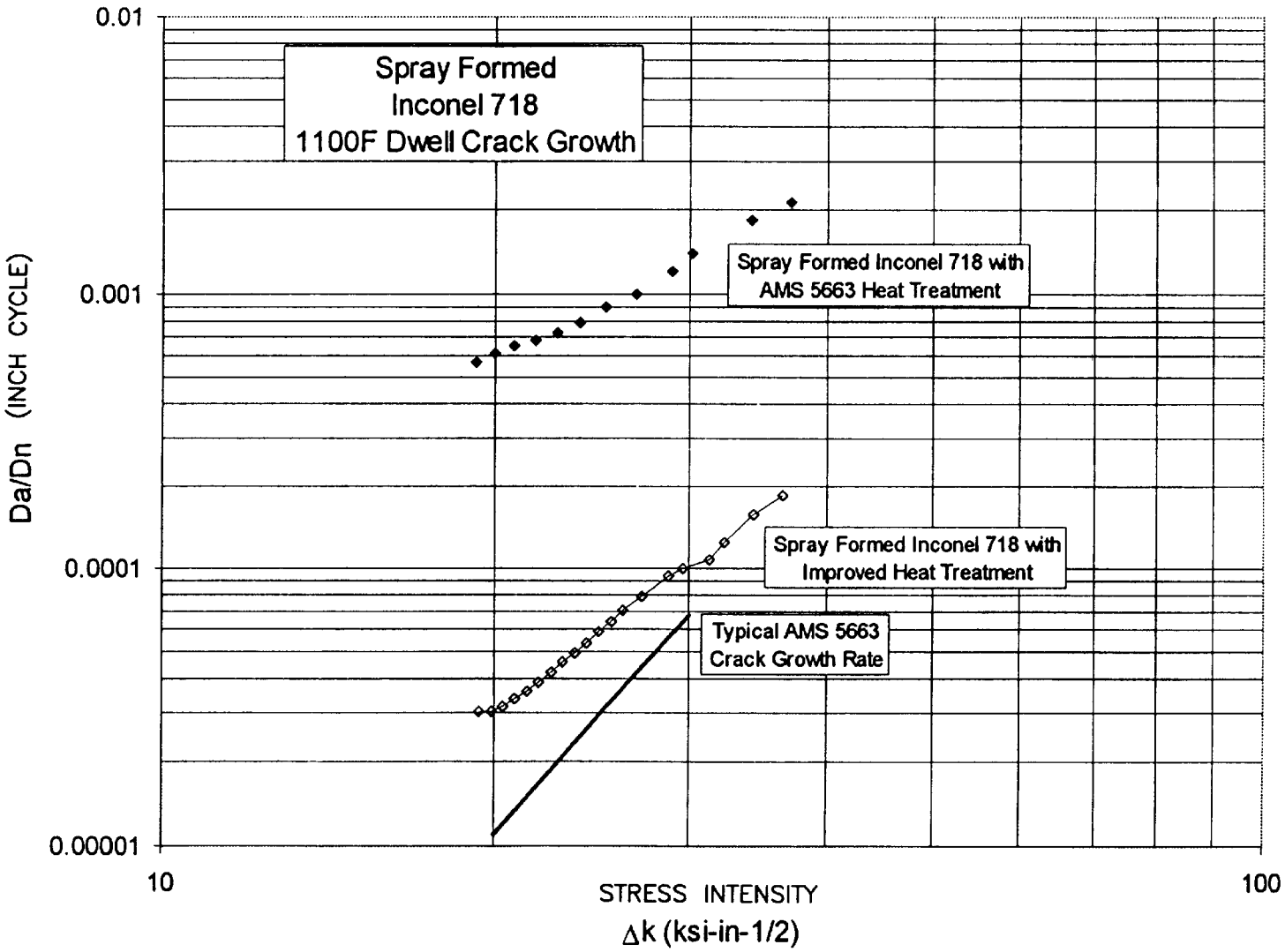
FIG. 5 is a graph illustrating crack growth rates of articles fabricated from IN 718, but fabricated and processed using different methods.

With respect to components intended for use in gas turbine engines and turning now to FIG. 5, the crack growth rates of test samples fabricated from IN 718 were evaluated (at 1100° F.) and tested, pursuant to the procedures set forth in the specification ASTM E292, published by the American Society for Testing and Materials in West Conshohocken, Pa., and which is incorporated herein by reference. As illustrated, test articles composed of IN 718 forged and heat treated in accordance with AMS 5663 exhibited crack growth rates between about 0.00001–0.00007 inch/cycle over a corresponding stress intensity (K) range between about 20–30 ksi•$(in)^{0.5}$. In the tests, each "cycle" simulates the operating environment in an engine operating at full power for two minutes, the "dwell" indicated in FIG. 5, and is designed to correspond to a simulated take-off, typically one of the most demanding aspects of a gas turbine engine operation.

Samples of sprayformed IN 718 that were HIP'ed and then heat treated in accordance with AMS 5663 exhibited crack growth rates of between about 0.0006–0.002 inch/cycle over a stress intensity (K) range of between about 20–50 ksi•$(in)^{0.5}$—about two orders of magnitude higher than the forged component and unacceptably high when early failure of a component is a concern.

A sample of sprayformed, HIP'd IN 718 that was heat treated in accordance with the present invention exhibited a rate of between about 0.00003–0.0002 inch/cycle over a stress intensity (K) range between about 20–35 ksi•$(in)^{0.5}$—which is comparable to the values for the forged component. With respect to sprayformed, HIP'd IN 718 parts processed in accordance with the present invention, it is believed that an upper limit for crack growth rates is within one order of magnitude faster than the indicated crack growth rate for forged IN 718 which meets the requirements of AMS 5663.

In addition, samples of sprayformed IN 718, HIP'd and heat treated in accordance with the present invention are characterized by relatively small grains. As measured by specification ASTM E112, equiaxed grain sizes are ASTM 5 (five) or finer, with some grains as large as ASTM 3 (three), which is comparable to the grains in corresponding forged material heat treated in accordance with AMS 5663. The microstructure of the finished material is substantially more homogeneous and isotropic in properties than forged material, and is also characterized by the absence of elemental segregation, in contrast to forgings. Since the spray formed material is not plastically deformed, sections of the material are characterized by an absence of flow lines, i.e., which indicate the direction of plastic flow. Moreover, the finished material exhibits low crack growth rates and good stress rupture resistance in addition to an absence of porosity.

The present heat treatment is not interchangeable with standard heat treatments, such as AMS 5663. As discussed above, standard heat treatments for IN 718, such as AMS 5663 do not produce satisfactory results when applied to sprayformed articles. In particular, spray formed articles heat treated in accordance with AMS 5663 exhibit extremely high crack growth rates compared to corresponding forged articles—up to about 2 orders of magnitude faster, and would have correspondingly shortened useful lives in demanding applications, such as gas turbines. Moreover, such articles do not have good stress rupture resistance, further limiting their usefulness. We have applied the present heat treatment to test samples of forged IN 718, and have determined that the resulting articles also do not exhibit a good balance of strength, crack growth rates or stress rupture resistance.

In sum, the present invention provides other significant advantages over forgings. Generally, the present invention enables spray forming to be used in the direct production of components that have properties comparable to forging. Parts produced in accordance with the present invention are more consistent, with more homogeneous microstructures. Individual parts exhibit isotropic microstructures. The parts are also characterized by a microstructure lacking segregation, especially relative to forgings. These properties also provide components fabricated in accordance with the present invention that are more easily machined and inspected. The present invention also provides material having a hardness of at least 300 HB or harder, and preferably at least 330 HB or harder.

Moreover, the present invention obviates the need to obtain specially-prepared billets of material, and long lead times associated with obtaining billets are therefore minimized or eliminated. The present invention enables bulk material to be converted directly to ready-to-machine or use components. Thus, a substantial portion of the effort, expense and waste associated with forging is substantially reduced or eliminated.

In sum, spray formed articles processed in accordance with the present invention exhibit not only strengths similar to the conventional, forged articles, but also resist crack growth rates and stress rupture resistance as well as forged articles. Moreover, articles prepared in accordance with the present invention are manufactured at significantly reduced time and expense.

While the present invention has been described above in some detail, numerous variations and substitutions may be made without departing from the spirit of the invention or the scope of the following claims. Accordingly, it is to be understood that the invention has been described by way of illustration and not by limitation.

What is claimed is:

1. A metal article composed of IN 718 nickel-base superalloy having an isotropic microstructure and formed by metal droplets built up on one another and heat treated to reduce porosity to have crack growth rates and stress rupture resistance comparable to the values for corresponding forged components heat treated in accordance with AMS 5663.

2. The article of claim 1, wherein the article has a yield strength at room temperature of at least about 140 ksi and at about 1200 F of at least about 120 ksi.

3. The article of claim 1, wherein the article has a tensile strength at room temperature of at least about 180 ksi and at about 1200 F of at least about 150 ksi.

4. The article of claim 1, wherein the article has an annular shape.

5. The article of claim 1, wherein the article is a gas turbine engine component.

6. The article of claim 5, wherein the article is selected from the group consisting of an engine case, an engine flange, and an engine seal.

7. The article of claim 1, wherein the material has a composition in weight percent of about 0.02–0.04 C, 17–21 Cr, up to about 1 Co, 2.8–3.3 Mo+W+Re, 5.15–5.5 Cb+Ta, 0.75–1.15 Ti+V+Hf, 0.4–0.7 Al, up to about 19 Fe, balance generally Ni.

8. The article of claim 7, wherein the balance is composed of up to about 0.35 Mn, up to about 0.15 Si, up to about 0.01 S, up to about 0.015 P, 0.002–0.006 B, up to about 0.10 Cu, up to about 0.0030 Mg, up to about 0.0005 Pb, up to about 0.00003 Bi, up to about 0.0003 Se, and up to about 0.0005 Ag.

9. The article of claim 7, wherein the balance is composed of up to about 0.01 O, up to about 0.01 N.

10. The article of claim 1, wherein the article has a microstructure characterized substantially by grains of a size less than ASTM 5, as measured in accordance with ASTM E129.

11. A method of generating a spray formed article composed of nickel-base superalloy and having enhanced stress rupture and crack growth resistance characteristics, comprising the steps of:

spray forming an article composed of IN 718, the article as spray formed characterized by a porosity of between about 1–3 percent by volume; and heat treating the article sufficiently to reduce porosity and provide an article having crack growth rates and stress rupture resistance comparable to the values for corresponding forged components heat treated in accordance with AMS 5663.

12. The method of claim 11, wherein the step of heat treating also provides an article having an isotropic microstructure.

13. The method of claim 11, wherein the step of heat treating also provides an article having a yield strength at room temperature of at least about 145 ksi and at about 1200 F of at least about 120 ksi.

14. The method of claim 11, wherein the step of heat treating also provides an article having a tensile strength at room temperature of at least about 180 ksi and at about 1200 F of at least about 150 ksi.

15. The method of claim 11, wherein the article has an annular shape.

16. The method of claim 11, wherein the article is a gas turbine engine component.

17. The method of claim 11, wherein the material has a composition in weight percent of about 0.02–0.04 C, 17–21 Cr, up to about 1 Co, 2.8–3.3 Mo+W+Re, 5.15–5.5 Cb+Ta, 0.75–1.15 Ti+V+Hf, 0.4–0.7 Al, up to about 19 Fe, balance generally Ni.

18. The method of claim 17, wherein the balance is composed of up to about 0.35 Mn, up to about 0.15 Si, up to about 0.01 S, up to about 0.015 P, 0.002–0.006 B, up to about 0.10 Cu, up to about 0.0030 Mg, up to about 0.0005 Pb, up to about 0.00003 Bi, up to about 0.0003 Se, and up to about 0.0005 Ag.

19. The method of claim 17, wherein the balance is composed of up to about 0.01 O and up to about 0.01 N.

20. The method of claim 11, wherein the step of heat treating also provides an article having a microstructure substantially characterized by grains of a size less than ASTM 5, as measured in accordance with ASTM E129.

21. The method of claim 11, wherein the step of heat treating includes the steps of:

solution heat treating the article;

stabilization heat treating the article; and precipitation heat treating the article.

22. The article of claim 1, wherein the article has a hardness of at least 300 HB or equivalent.

* * * * *